US006357583B1

(12) United States Patent
Rainen

(10) Patent No.: US 6,357,583 B1
(45) Date of Patent: Mar. 19, 2002

(54) ASSEMBLY FOR COLLECTION, TRANSPORT AND DISPENSING OF BIOLOGICAL SAMPLES

(75) Inventor: Lynne C. Rainen, Maplewood, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 09/557,624

(22) Filed: Apr. 25, 2000

(51) Int. Cl.[7] ..... B65D 85/50
(52) U.S. Cl. ..... 206/205; 206/564; 422/102
(58) Field of Search ..... 206/204, 205, 206/564, 565, 569; 422/61, 102

(56) References Cited

U.S. PATENT DOCUMENTS 3,814,236 A * 6/1974 Keilman ..... 206/564
4,240,547 A * 12/1980 Taylor ..... 206/204
4,549,655 A * 10/1985 Forsythe, Jr. et al. ..... 206/569
5,052,560 A * 10/1991 Stringham ..... 206/564
5,310,523 A * 5/1994 Smethers et al. ..... 422/102
5,450,948 A * 9/1995 Beausoleil et al. ..... 206/204
5,846,487 A * 12/1998 Bennett, II ..... 422/102
6,051,187 A * 4/2000 Hughes ..... 422/61

* cited by examiner

*Primary Examiner*—Jim Foster
(74) *Attorney, Agent, or Firm*—Nanette S. Thomas

(57) ABSTRACT

A sample collection assembly provides for the collection, transport and dispensing of a plurality of discrete biological samples. The assembly includes a sample tray which supports sample wells in spaced apart registration. The sample wells are provided for the collection of the discrete biological samples. The sample tray including the sample wells is supported in a sample tray case which encloses the sample tray. The sample tray is movably accommodated within the case for movement between a first position enclosing the sample wells to a second position rendering exteriorly accessible one of the sample wells to permit dispensement of the sample well from the tray.

6 Claims, 4 Drawing Sheets

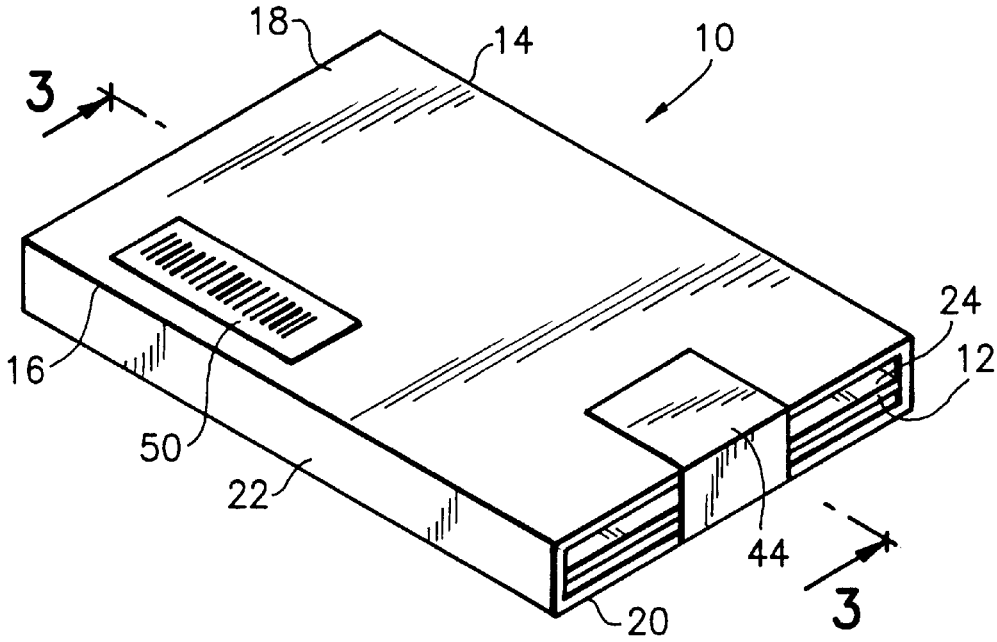
FIG. 1
FIG. 3
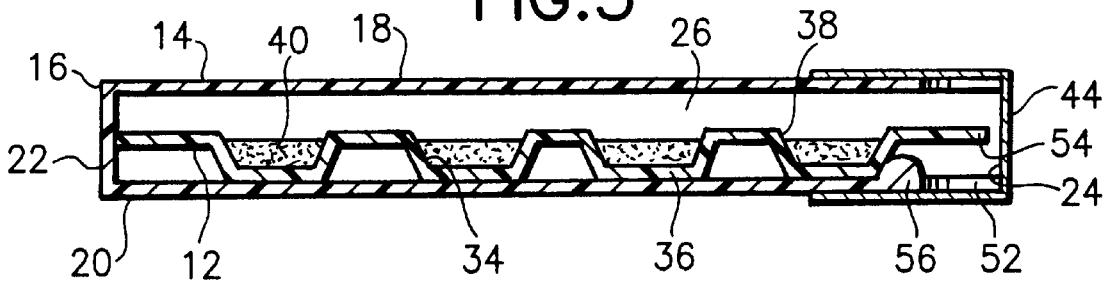

ASSEMBLY FOR COLLECTION, TRANSPORT AND DISPENSING OF BIOLOGICAL SAMPLES

BACKGROUND OF THE INVENTION

1. Field of the Invention

The present invention relates to an assembly for the collection, transport and dispensing of discrete biological samples. More particularly, the present invention relates to improved packaging which provides for accommodation of wells containing biological samples which permits the individual dispensement of the biological sample into an assay vessel.

2. Description of Related Art

In clinical diagnostic settings, it is often been necessary to collect various biological specimens such a whole blood, plasma, serum, CFS, feces, urine, cultured cells, saliva, cervical or urethral swab, sputum and other biological fluids. Multiple individual samples are collected and transported to a laboratory where personnel conduct specific tests on the samples. It is imperative that the biological samples be properly contained, enclosed and identified to permit the safe transport of the sample from the collection location to the laboratory.

Currently, blood and other biological fluid samples are collected on paper substrates. This procedure involves dotting the sample fluid onto a card or dipping a paper strip into a bulk sample of the fluid. The sample on the card or the paper strip is then dried. The dried sample is then punched or cut from the remainder of the card or strip manually. Typically, a punch or other cutting device is used to cut the individual dotted sample from the remainder of the card or strip. However, in order to prevent cross-contamination between adjacent samples on the same card or strip, the mechanical punch or cutting device must be decontaminated between samples. This increases the time and cost involved in obtaining discrete samples.

Perforated cards or strips are also used which permit the technician to rip or tear a portion of the card or strip from the remainder thereof. While this eliminates the need for a separate punch, in most laboratory settings these perforated strips are awkward to use.

The sample cards used to obtain the samples are typically exposed to the environment during collection, testing and transporting. This increases the risk of contamination of the samples. Such contamination risk is especially significant in DNA testing where minute amounts of contamination from such sources as dust, hair, skin tissue and the like may jeopardize the integrity of the test.

Thus, collected samples must be adequately isolated, packaged and identified to permit the safe, efficient and identifiable transport of the samples to the laboratory while preventing contamination of the samples. It is therefore desirable to provide an improved packaging which allows for the collection transport and dispensing of individual discrete samples from a plurality of collected samples.

SUMMARY OF THE INVENTION

The present invention provides a sample collection assembly for collection, transport and dispensing of a plurality of discrete biological samples. The collection assembly includes a plurality of sample wells for collecting individual biological samples. The sample wells are supported in a sample tray in spaced apart registration. The sample tray is supported within a case which encloses the sample tray and allows the safe and efficient transport of the sample wells. The sample tray is movably accommodated within the case for movement between a first position enclosing the plurality of sample wells, to a second position rendering exteriorly accessible one of the sample wells so that the sample can be manually dispensed from the tray.

It is contemplated that the sample wells may be in the shape of open ended cup-like members which may include therein solid phase material used for sample testing. The tray may be formed of a planar member having the sample wells formed therein. The individual cup-like wells may be manually deformed so as to dispense the solid phase material including the biological sample from the wells.

In one embodiment of the present invention, the case is generally in the shape of open-ended parallelepiped and the tray is rectangular. The tray is slidably movable with respect to the case through the open end so as to sequentially render accessible one of the wells to permit dispensement of the sample contained therein. The case in the tray may include cooperating indexing means to allow the tray to be supported at an indexed location, with each well being sequentially accessible at each indexed location.

In another embodiment of the present invention, the case is generally cylindrical and the tray is generally circular. The tray is rotatably movable within the case. The case includes cut out portions along a circumferential edge thereof so as to sequentially render accessible one of the wells upon rotative movement of the tray with respect to the case.

The case may include identification indicia such as, for example, bar coding to enable the proper identification of the samples in the case.

It is contemplated that the present invention may be used to collect various biological specimens such as whole blood, plasma, serum, CFS, feces, urine, cultured cells, saliva, cervical or urethral swab, sputum and any other biological fluids. While collection of these biological fluids are all within the contemplation of the present invention, preferred embodiments will be described with respect to the collection of discrete blood samples.

DESCRIPTION OF THE DRAWINGS

FIG. 1 is a perspective view of the sample collection assembly of the present invention including a sample tray enclosed within a sample case.

FIG. 3 is a sectional view of the sample collection assembly of FIG. 1 taken through the lines 3—3 thereof.

DETAILED DESCRIPTION

Figure 2:
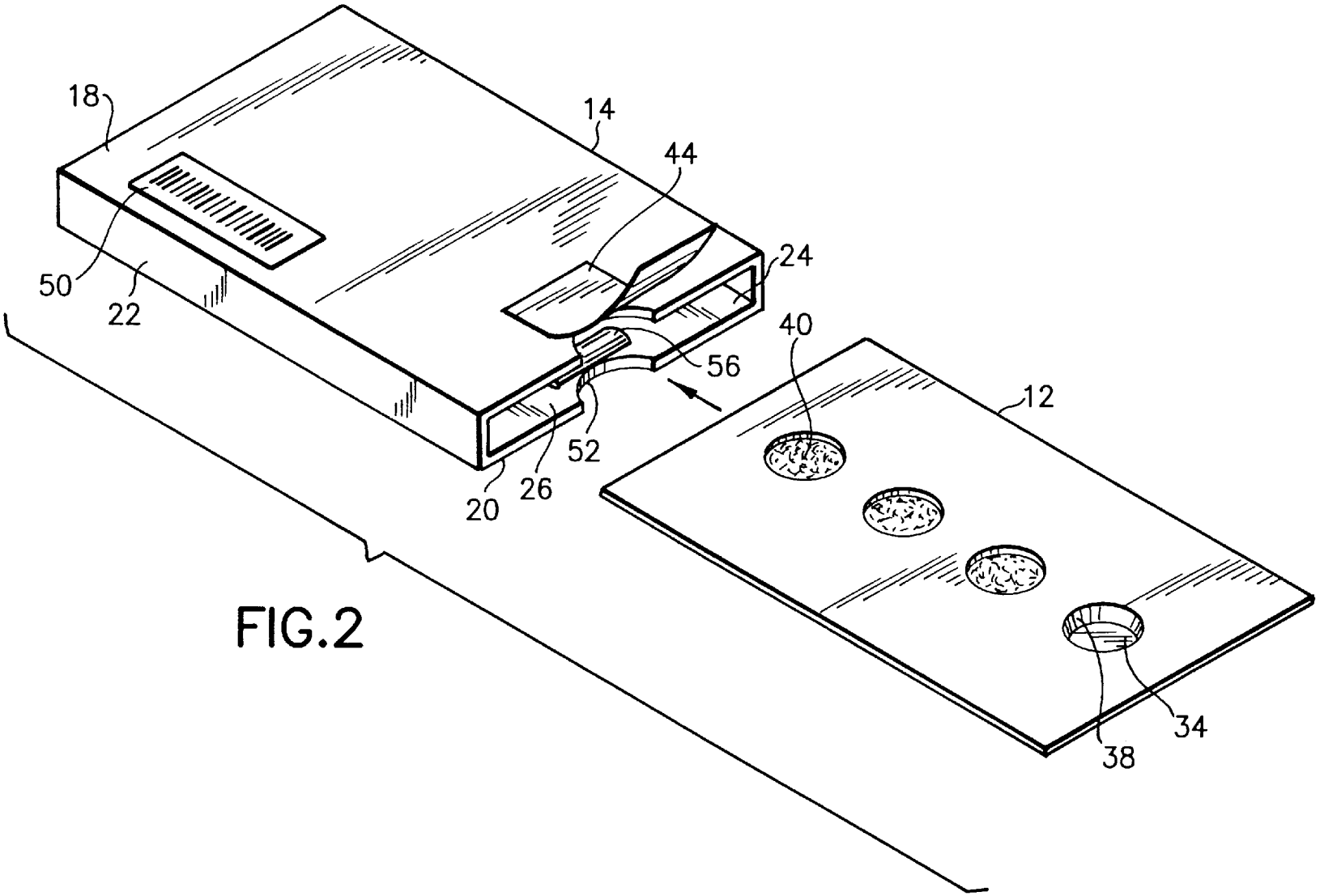
FIG. 2 is an exploded perspective view of the sample collection assembly of FIG. 1 showing the sample tray removed from the sample case.

As shown in FIGS. 1–3, a sample collection assembly 10 of the present invention includes a sample collection tray 12 and a sample collection case 14 which insertably accommodates sample collection tray 12. Sample collection case 12 includes a parallelepiped shaped housing 16 having upper and lower rectangular shaped planar walls 18 and 20 separated by a perimetrical side wall 22 extending about three sides thereof. Housing 16 includes an open transverse end 24 which permits the insertable slidable accommodation of tray 12 into an interior 26 of housing 16. Housing 16 may be formed of any suitable material including plastic, cardboard, paper stock and the like.

As shown in FIGS. 2 and 3, sample tray 12 includes a plurality of longitudinally spaced blister depressions forming specimen collection wells 34. Sample tray 12 may be formed of a suitably deformable plastic material commonly manufactured from blister packaging. Wells 34 have a bottom 36 and an open end 38. Wells 34 are constructed to have sufficient depth so as to retain a suitable volume of a fluid sample. Wells 34 may each accommodate therein a sample disk 40 for retaining the fluid sample. Sample disks 40 may be formed of solid phase materials such as paper or fritted glass. Disks 40 accommodate a fluid biological sample such as blood which is dotted thereon. The blood sample is then dried on the disk to permit safe transport to the laboratory.

Upon collection of blood samples on disks 40 within wells 34, tray 12 is inserted into open end 24 of housing 16 and then within interior 26 until all wells 34 are enclosed by case 14.

Once tray 12 is positioned within case 14, a tamper evident label or seal 44 is placed over open end 24 of case 14 to close open end 24 securely retaining tray 12 within interior 26 and also to prevent nonevident removal of the tray therefrom. Case 14 may further include an appropriate identification device such as a bar code 50 thereon so as to provide identification of the samples contained within tray 12.

Sample collection assembly 10 is then transported to a laboratory where appropriate testing can be conducted on the discrete blood samples contained within wells 34 of tray 12. In order to conduct such testing, a laboratory technician removes the tamper evident seal 44 and removes tray 12 from its enclosed position within case 14 to a position where each of the wells 34 are progressively exposed.

The removal of tray 12 from case 14 is facilitated by a cut out portion 52 through a transverse edge of upper and lower planar walls 18 and 20 adjacent open end 24. Cut out portion 52 enables the technician to manually grasp an edge 54 of the tray contained within case 14. The laboratory technician then withdraws tray 12 from its fully enclosed initial position to a further position where the first well 34 of the tray is exposed externally of case 12. The technician then inverts the sample collection assembly and manually dislodges disk 40 in first well 34 from tray 12. Such dislodgement is achieved by depressing bottom 36 of well 34 to dispense the disk 40 containing the blood sample. Disks 40 are frictionally retained in wells 34 and may be removed by such manual dislodgement. Thereafter, the technician further extracts tray 12 from case 14 to a position which renders accessible the next adjacent well 34 for removal of the next disk therefrom.

Case 14 provides indexed movement of tray 12 whereby lower planar wall of housing 16 may include an inwardly directed raised edge 56 adjacent open end 24 which engages, in an interference manner, lower surfaces 36 of wells 34 as the tray is moved with respect to housing 16. Raised edge 56 temporarily holds the tray in position to permit the individual dispensement of disks 40 therefrom.

While tray 12 of the present invention is shown having a single row of wells 34 formed therein, the present invention contemplates that the wells may be provided in any number or any array desirable for a particular testing situation.

Figure 4:
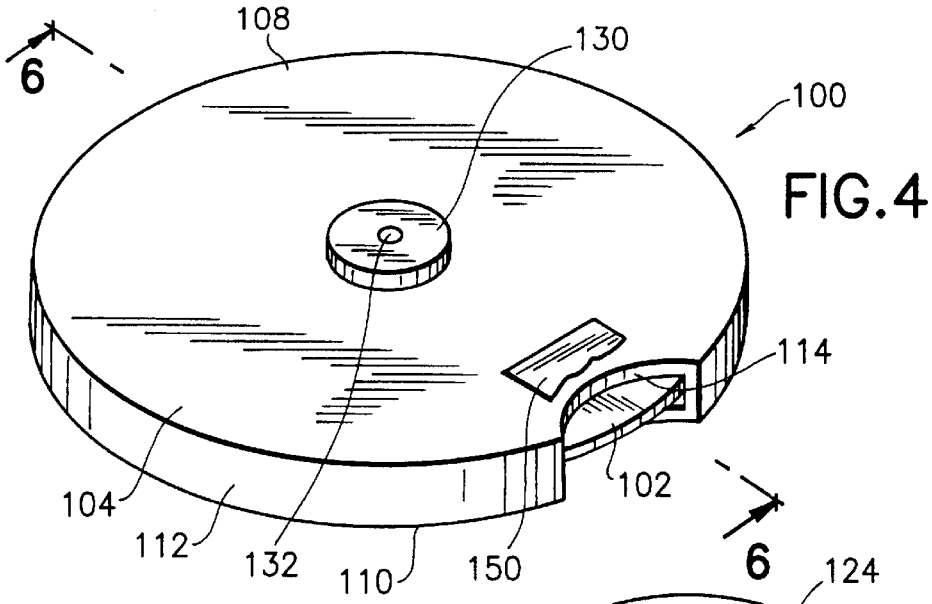
FIG. 4 is a perspective view of an embodiment of the sample collection assembly of the present invention.
Figure 5:
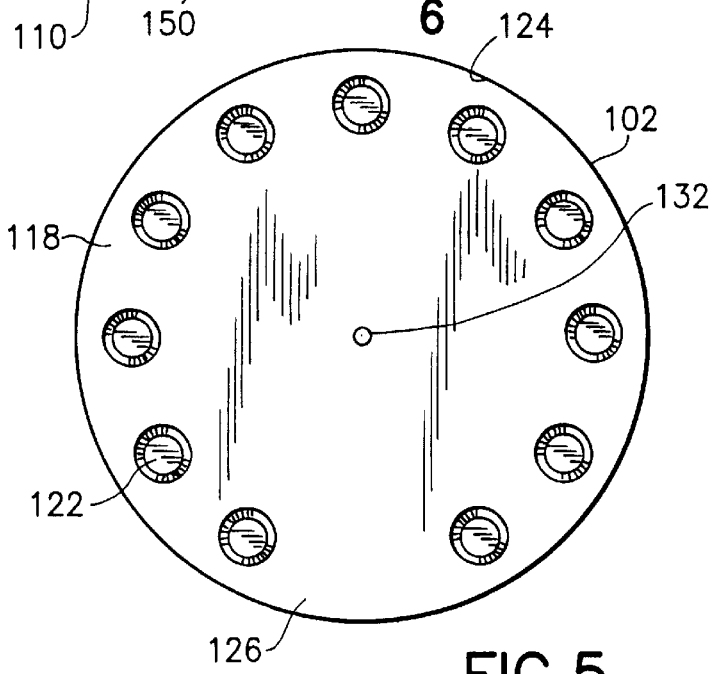
FIG. 5 is a top plan view of the sample tray of the collection assembly of FIG. 4.
Figure 6:
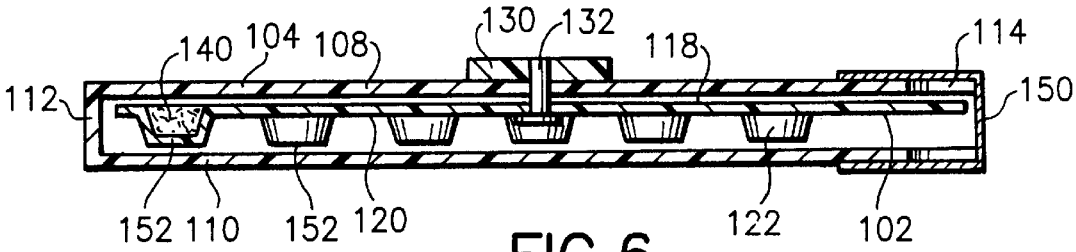
FIG. 6 is a sectional view of the sample collection assembly of FIG. 4 taken through the lines 6—6 thereof.

A further embodiment of the invention, sample collection assembly 100 is shown in FIGS. 4–6. Sample collection assembly 100 includes a sample collection tray 102 and a case 104 for supporting tray 102. Case 104 is a cylindrical housing having an upper and a lower circular wall 108 and 110 separated by an annular sidewall 112. Upper and lower walls 108 and 110 as well as side wall 112 include an arcuate cut out portion 114 extending therethrough. Cut out portion 114 allows the sample wells of tray 102 to be exposed for collection and dispensing.

Tray 102 is a circular planar member having opposed an upper and a lower surface 118 and 120. A plurality of blister like depressions define wells 122 therein. Wells 122 are arranged circularly about the circumference 124 of tray 102. The wells may be uniformly spaced about circumference 124 with at least one extended location 126 including no well. Tray 102 is rotatably supported within case 104 in a manner which permits wells 122 to be sequentially and selectively exposed at cut out portion 114 of case 104.

Sample collection assembly 100 further includes a dial 130 and an axis 132 for rotatably coupling tray 102 to case 104. Dial 130 rotates about axis 132. Dial 130 may be externally accessed to permit manual rotation of the tray with respect to the case.

In use, wells 122 are selectively rotated to a position adjacent cut out 114 where a fluid biological sample may be collected on a disk 140 that is frictionally held within wells 122. Once the sample is collected in each of wells 122, tray 102 is rotated to a position where extended location 126 is aligned with cut out portion 114. A tamper evident seal 150 may be positioned over cut out portion 114 of case 104 to secure tray 102 within the case to provide tamper indication.

Sample collection assembly 100 is then transported to a laboratory for testing purposes. The laboratory technician removes tamper evident seal 150 and selectively rotates the tray by using dial 130 to sequentially access each well 122. Then, case 104 is inverted and wells 122 are depressed from an under surface 152 thereof to dispense biological dotted disk 140 therefrom. Tray 102 is continually rotated until each of the desired disks are dispensed from the tray.

Figure 7:
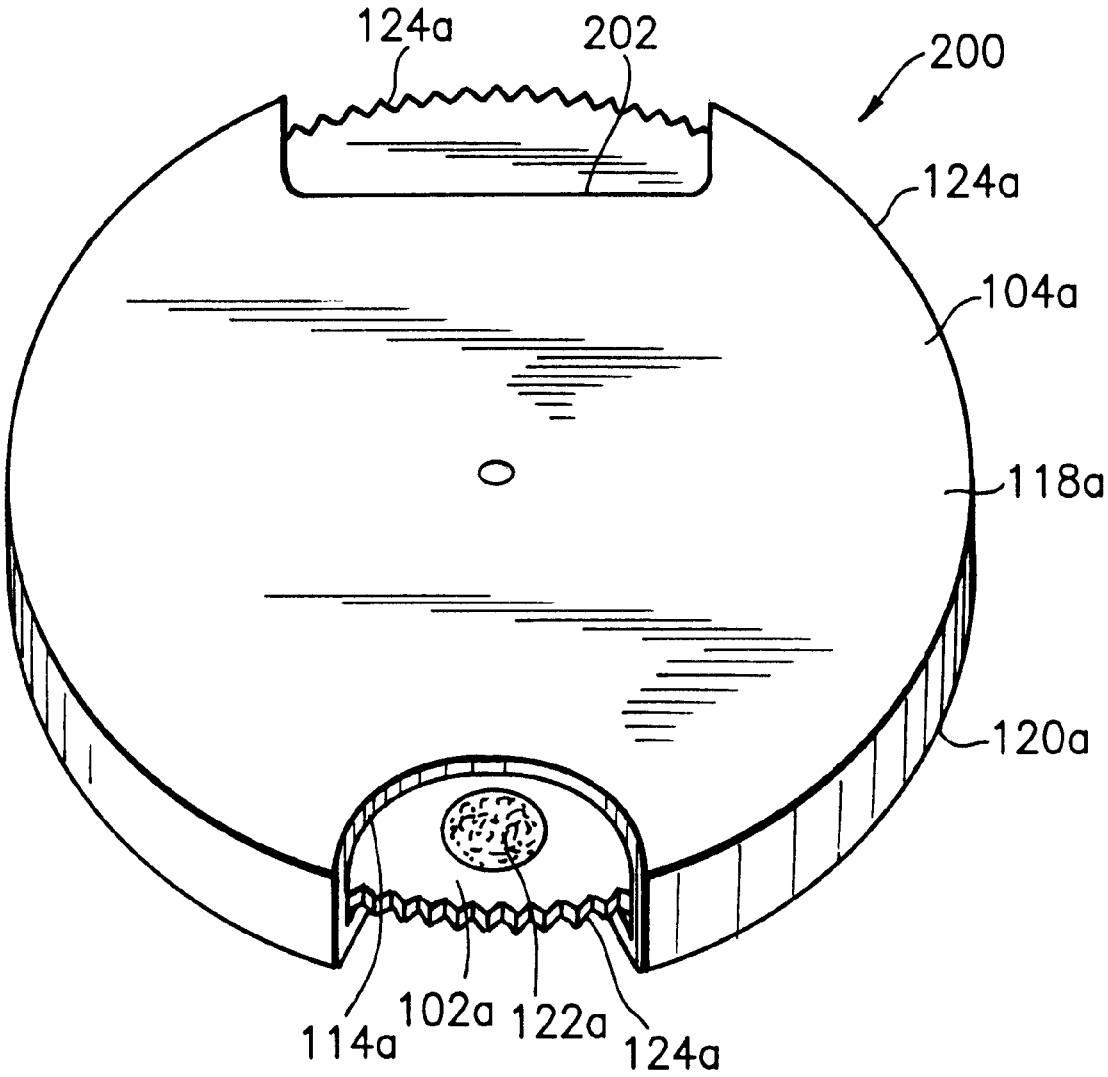
FIG. 7 is a perspective view of an embodiment of the sample collection assembly of the present invention.

FIG. 7 is a further embodiment of the invention that includes many components which are substantially identical to the components of FIGS. 4–6. Accordingly, similar components performing similar functions will be numbered identically to those components of FIGS. 4–6, except that a suffix "a" will be used to identify those similar components in FIG. 7.

As shown in FIG. 7, sample collection assembly 200 includes case 104*a* having a cut out portion 202 diametrically spaced from first cut out portion 114*a* which permits manual access to tray 102*a*. Cut out portion 202 extends through opposed upper and lower circular walls 118*a* and 120*a*. Cut out portion 202 extends a sufficient arcuate extent to permit extended manual access to tray 102*a*. The circumferential edge 124*a* of tray 102*a* may be knurled so as facilitate manual rotation of tray 102*a* with respect to case 104*a*. While cut out 202 is sufficient to provide access to the knurled edge of tray 102*a*, cut out portion 114*a* is sufficiently shallow to prevent exposure of wells 122*a*.

What is claimed is:

1. An assembly for collection, transport and dispensing of a plurality of discrete biological samples comprising:

a sample tray;

a plurality of sample wells supported by said tray in spaced apart registration for collecting said discrete biological samples;

a sample tray case for supporting and enclosing said sample tray comprising an elongate container having an open end and an access port, said tray being insertable into said container through said open end wherein said case is generally in the shape of a cylinder having spaced apart upper and lower generally circular surfaces and a cylindrical side wall therebetween, said access port being a cut out portion through said upper and lower circular surfaces adjacent to the circumference thereof;

said sample tray being movably accommodated within said case for movement between a first position enclosing said plurality of sample wells to a second position rendering exteriorly accessible at least one of said sample wells for dispensing of said biological sample from said at least one sample well;

said tray is generally a circular planar member, having said wells positioned about the circumference thereof and is rotatable with respect to said cylinder to move said one said sample well to said second position;

wherein said first position is defined by none of said tray wells being in registry with said cut out portion of said cylinder and wherein said second position being defined by one of said wells being in registry with said cut out portion of said case;

a manually operable exteriorly accessible dial forming part of said tray for effecting rotation of said tray with respect to said case;

a tamper evident seal enclosing said cut out portion in said first position; and said tray and said container include cooperative indexing means for providing indexed movement of said tray with respect to said case.

2. The assembly of claim 1, wherein said sample wells are open ended cup-like members.

3. The assembly of claim 2, wherein said tray includes a planar member having formed therein said sample wells.

4. The assembly of claim 3, wherein said wells are deformable for dispensing said biological samples therefrom.

5. The assembly of claim 4, wherein said wells support a solid phase material for retaining said biological sample.

6. The assembly of claim 5, wherein said solid phase material is dispensable from said wells upon said deformation of said wells.

* * * * *